US011974688B2

(12) United States Patent
Rothschild

(10) Patent No.: US 11,974,688 B2
(45) Date of Patent: May 7, 2024

(54) CLIP FOR A YOGA MAT

(71) Applicant: Nicole R. Rothschild, Westport, CT (US)

(72) Inventor: Nicole R. Rothschild, Westport, CT (US)

( * ) Notice: Subject to any disclaimer, the term of this patent is extended or adjusted under 35 U.S.C. 154(b) by 200 days.

(21) Appl. No.: 17/676,543

(22) Filed: Feb. 21, 2022

(65) Prior Publication Data

US 2023/0263322 A1 Aug. 24, 2023

(51) Int. Cl.
*A47G 9/06* (2006.01)
*A47C 21/02* (2006.01)

(52) U.S. Cl.
CPC ..... *A47G 9/062* (2013.01); *A47C 21/02* (2013.01)

(58) Field of Classification Search
CPC ..... A43C 21/02; Y10T 24/44504; Y10T 24/44598; Y10T 24/44974; A47C 21/02
See application file for complete search history.

(56) References Cited

U.S. PATENT DOCUMENTS 714,348 A * 11/1902 Youngblood ..... F16M 13/02 248/316.5
3,376,612 A 4/1968 Munse
D248,211 S 6/1978 Kirkland
4,536,924 A 8/1985 Willoughby
D315,675 S 3/1991 Kennedy
5,584,456 A 12/1996 Stephens
6,202,266 B1 * 3/2001 Van den Branden .. A47B 97/00 24/514
6,490,768 B1 12/2002 Goodall
6,711,787 B2 3/2004 Jungkind et al.
D552,978 S 10/2007 Liao
7,308,739 B2 12/2007 Andersen et al.
D613,498 S 4/2010 Tsai
D649,866 S 12/2011 Roehrig
D670,998 S 11/2012 Lavoie
D758,839 S 6/2016 Kaalberg
9,402,483 B2 8/2016 Kaalberg
D777,023 S 1/2017 Kaalberg
D816,476 S 5/2018 Shargh
D870,547 S 12/2019 Liao
2003/0115726 A1 * 6/2003 Liao ..... B60P 7/0823 24/569

(Continued)

OTHER PUBLICATIONS

Idquo;Plastic twist lock clip strap buckle for bag” alibaba.com (Accessed Sep. 5, 2021), (10 pages).

(Continued)

*Primary Examiner* — Robert Sandy
(74) *Attorney, Agent, or Firm* — Adam K. Sacharoff; Much Shelist, P.C.

(57) ABSTRACT

In one embodiment there is provided a clip for use with a yoga mat and towel. The clip includes a first and second plates each having a first and second jaw section, respectively. The jaw sections are disposed to face each other. The clip further includes a threaded knob configured to move the first and second plate such that the first jaw section and the second jaw section move into and out of open and closed configurations. The threaded knob is configured to fit within a well defined on the first plate and an opening defined on the second plate, such that a height profile of the threaded knob matches a height profile of the first and second plates when assembled.

19 Claims, 10 Drawing Sheets

(56) References Cited

U.S. PATENT DOCUMENTS

| | | | | |
|---|---|---|---|---|
| 2008/0104807 | A1 | 5/2008 | Hosfeld | |
| 2013/0025093 | A1* | 1/2013 | Liao | B60P 7/0823 24/514 |
| 2017/0079485 | A1 | 3/2017 | Johnson | |
| 2018/0296014 | A1 | 10/2018 | Carter | |
| 2019/0134484 | A1 | 5/2019 | Bova | |

OTHER PUBLICATIONS

Idquo;MatSnaps—Yoga Mat Towel Clips, The Best Yoga Accessory to Safely Secure Your Yoga Towel to Your Mat, Non-Skid Towel Solution for Yoga, Free Carrying Case Included, The Perfect Yoga Gift amazon.com (Feb. 17, 2016), (7 pages).

Idquo;Yoga Mat Towel Clips—Securely Holds Your Hot Yoga Towel and Mat Together | Colorful Nonslip Towel Clips Set of Four Prevents Bunched Towels” amazon.com (Oct. 20, 2017), (8 pages).

Idquo;HTF 63067 Multipurpose Tarp Clips 4 Pc” amazon.com (Jan. 24, 2018), (7 pages).

* cited by examiner

PLAN ELEVATION

FRONT ELEVATION

SIDE ELEVATION

CLIP FOR A YOGA MAT

FIELD OF THE INVENTION

The current invention relates generally to a clip and more specifically, to a clip for gripping the edges of a towel to a yoga mat.

BACKGROUND OF THE INVENTION

It is very common for a yoga studio to lay our yoga mats for participants. Yoga mats are often designed to wick away sweat; however, mats can still accumulate sweat causing the participant to slip during yoga poses. In addition, while mats can be cleaned prior to the use, if the studio forgets or they are not cleaned properly, mats can become dirty or infested with bacteria or viruses. Yoga participants therefore typically bring a towel to lay over the mat. This further helps to prevent slipping and offers a barrier between the participant's hands and feet and the yoga mat. One problem that participants face is that with various movements the towels will shift and move off the mat, causing the participant to constantly readjust the towel. While anti-slide mats or towels have been developed, these have proven to be ineffective over the years. As such that is a need for the development of yoga clip designed to secure the towel to the mat.

SUMMARY OF THE INVENTION

There is provided in one embodiment of the invention a clip for securing a towel to a yoga mat. In summary the clip includes two plates each having a base section and a jaw section distal to the base section. The jaw sections are disposed on the plates such that the jaw sections face each other and when in a closed configuration can grip the towel and mat together tightly to prevent slipping of one in relation to the other. The base section of the first plate includes an inwardly annular threaded section with an upwardly positioned shaft member centered within the annular threaded section. The base section of the second plate includes a circular opening with a shoulder section extended away from the base section and that is sized to fit over the annular threaded section. A threaded knob is provided to fit into the circular opening of the second plate and tightens with the annular threaded section in the first plate. The threaded knob has an internal bore sized to receive the shaft member. The shaft member includes wings on its upper end that squeeze through the internal bore and then expand to capture the threaded knob to the first plate. The threaded knob further includes an annular rim sized to fit over the edge of the circular opening of the second plate thus capturing the second plate to the first plate. The threaded knob is configured to rotate along the corresponding threads to move the plates into the closed and open configurations. The threaded knob includes finger indentations to allow the user to easily grip the threaded knob and twist to close or open. By closing the plates, the jaw sections are brought closure together to grip and capture a yoga mat to a towel.

Numerous other advantages and features of the invention will become readily apparent from the following detailed description of the invention and the embodiments thereof, from the claims, and from the accompanying drawings.

BRIEF DESCRIPTION OF THE FIGURES

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION OF THE INVENTION

Referring now to FIGS. 1-10 there is provided a clip 50 used for securing a towel 60 to a yoga mat 70. The clip 50 is illustrated in the figures as a single embodiment, however, various other shapes and sizes could be used or employed and the reference to a clip 50 actively incorporates such other embodiments.

Figure 5:
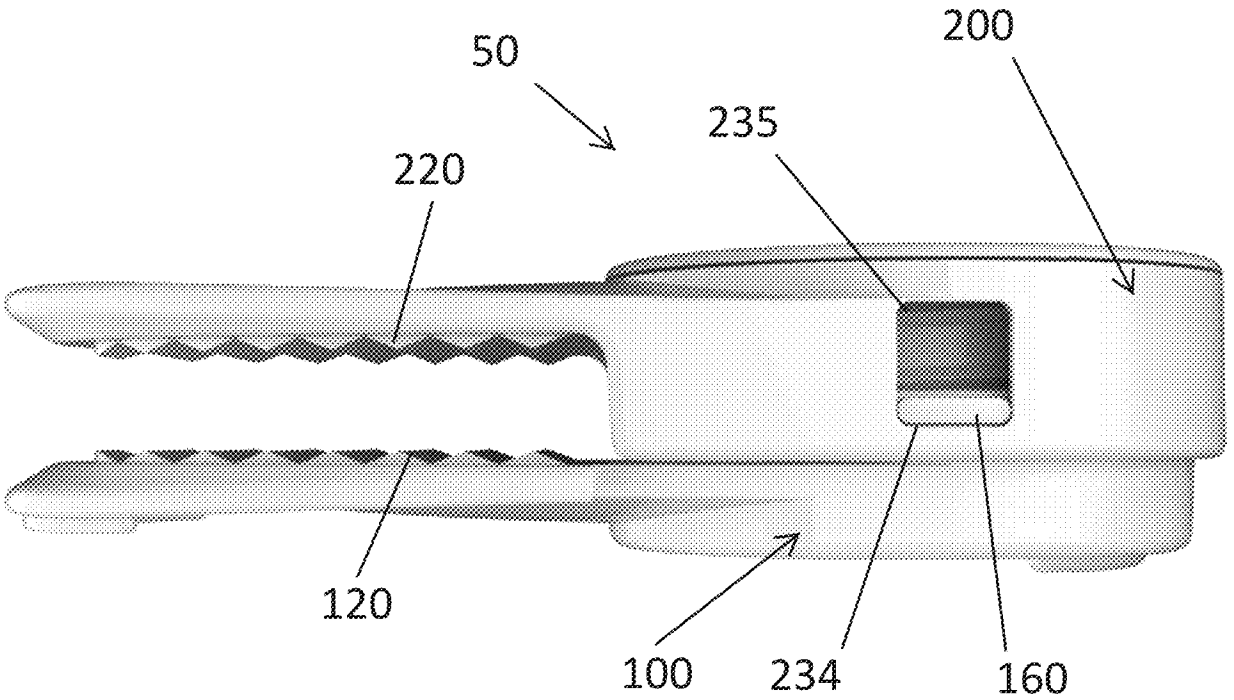
FIG. 5 is a side view of a yoga clip in the open configuration.
Figure 6:
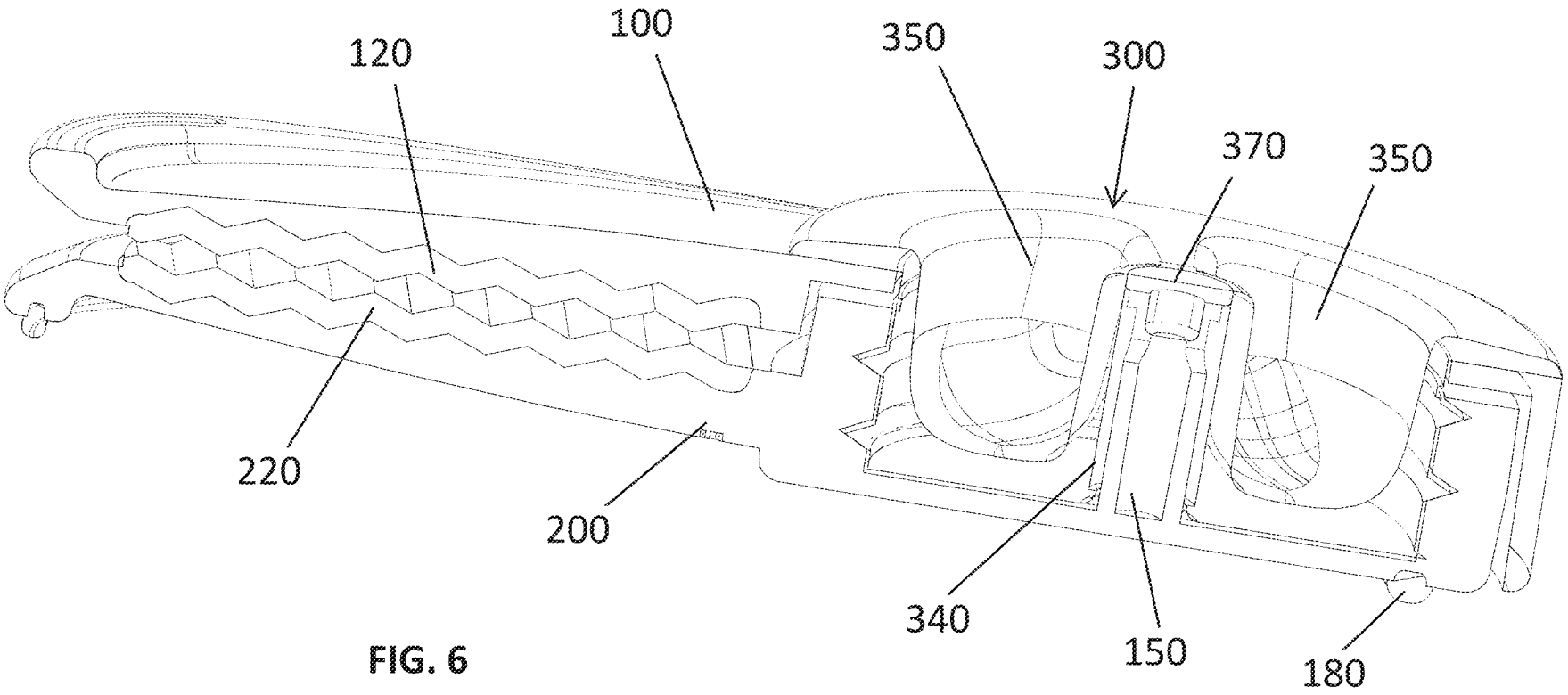
FIG. 6 is a section view of a yoga clip in accordance with one embodiment of the present invention.
Figure 7:
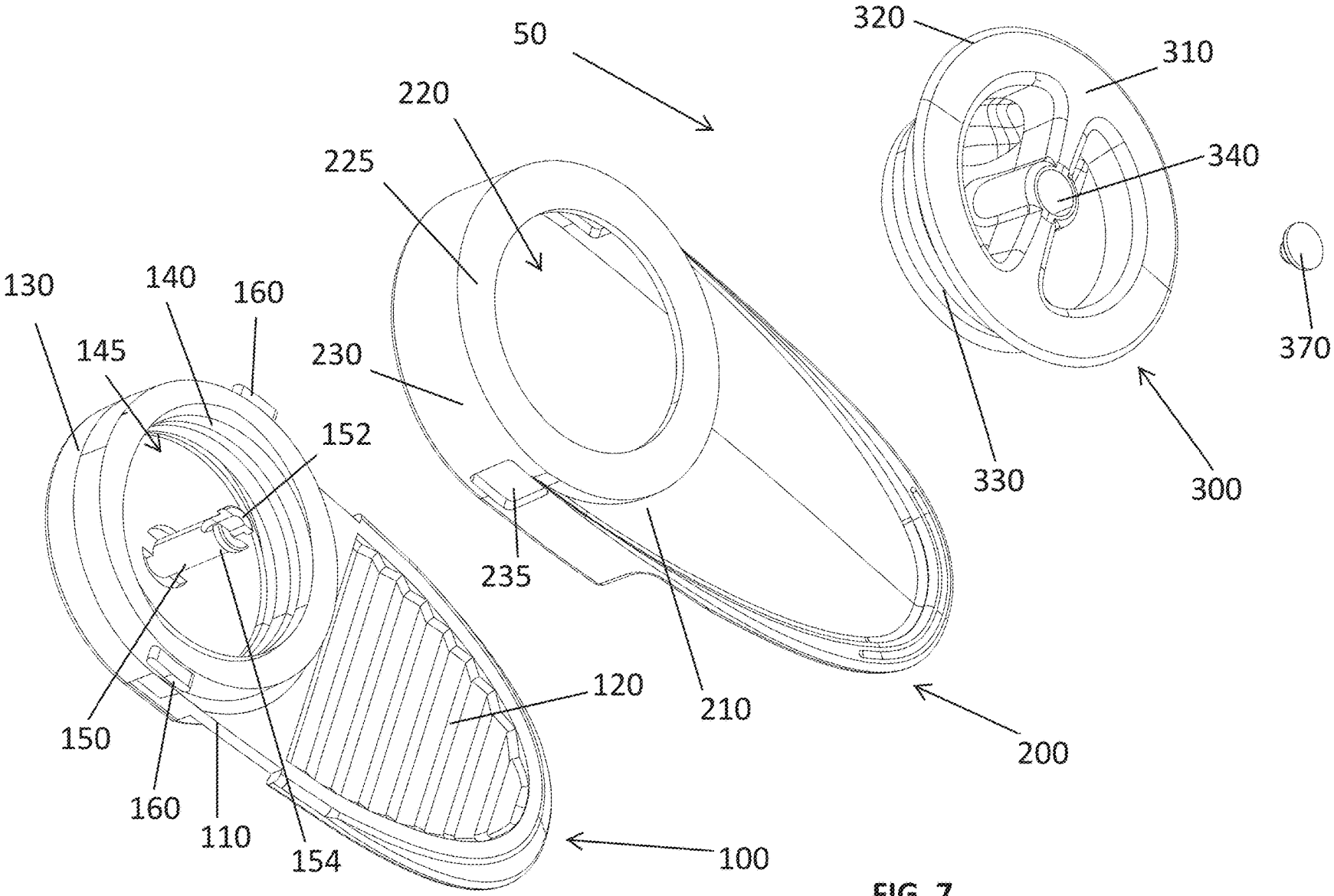
FIG. 7 is an exploded view of a yoga clip from the top view.
Figure 8:
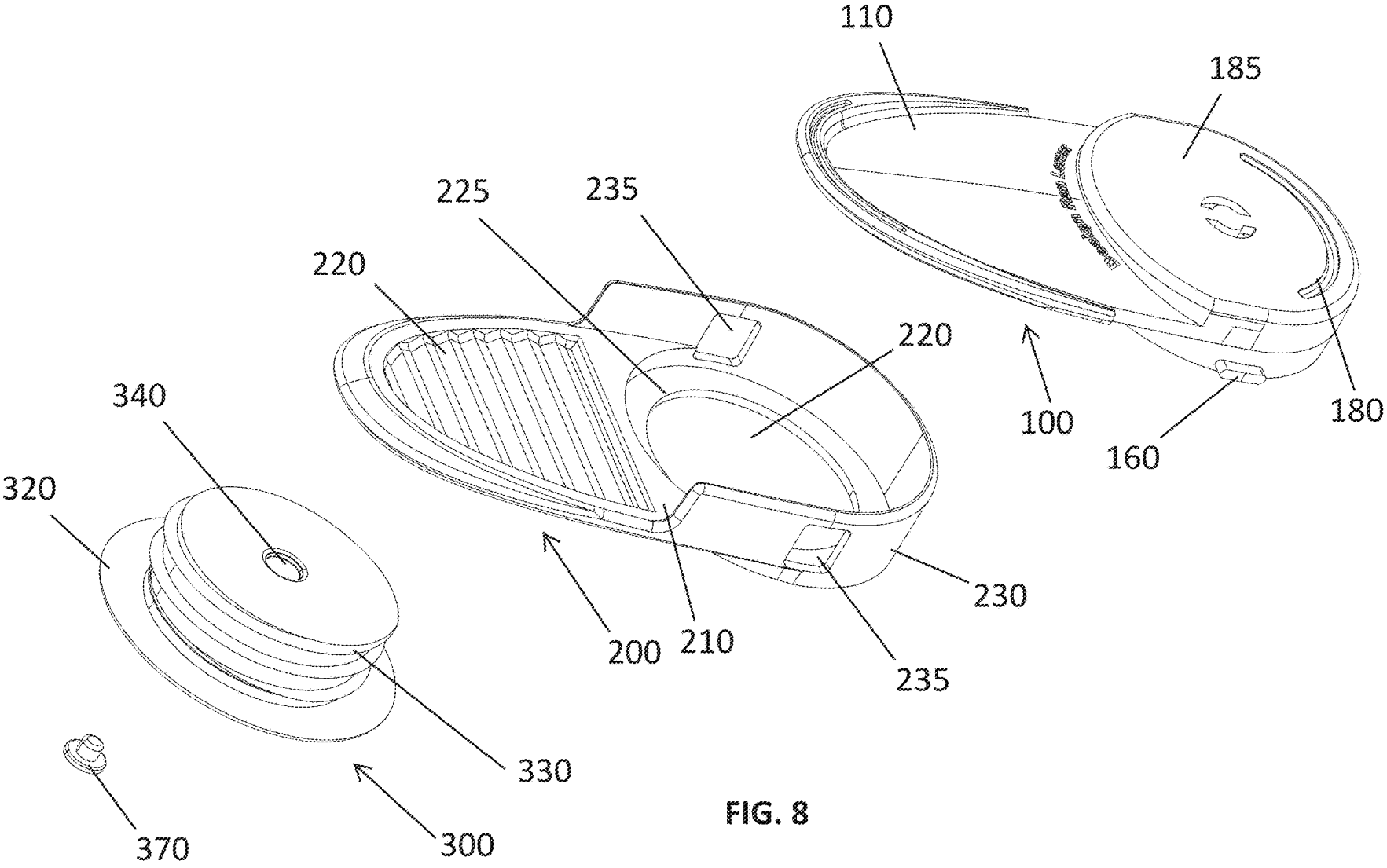
FIG. 8 is an exploded view of a yoga clip from the bottom view.
Figure 9A:
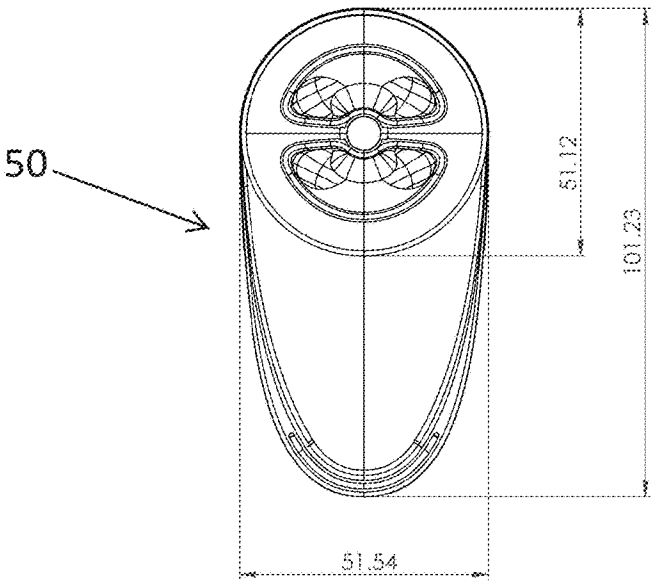
FIGS. 9A, 9B, and 9C are elevation view of a yoga clip showing preferred dimensions in accordance with one embodiment of the present invention.
Figure 9B:
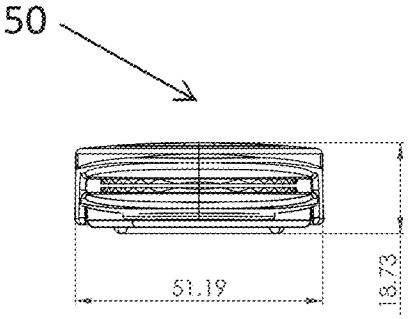
Figure 9C:
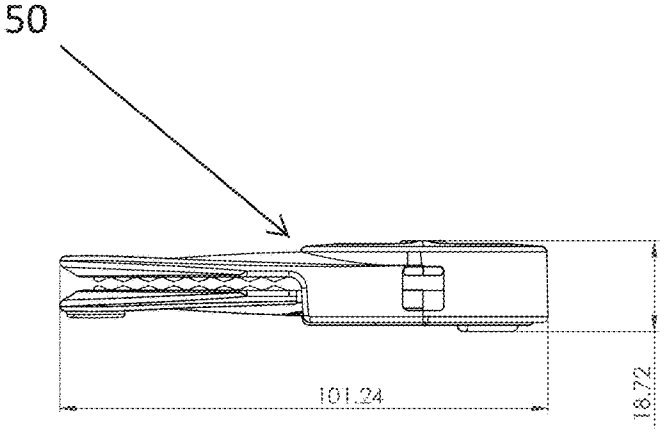
Figure 10:
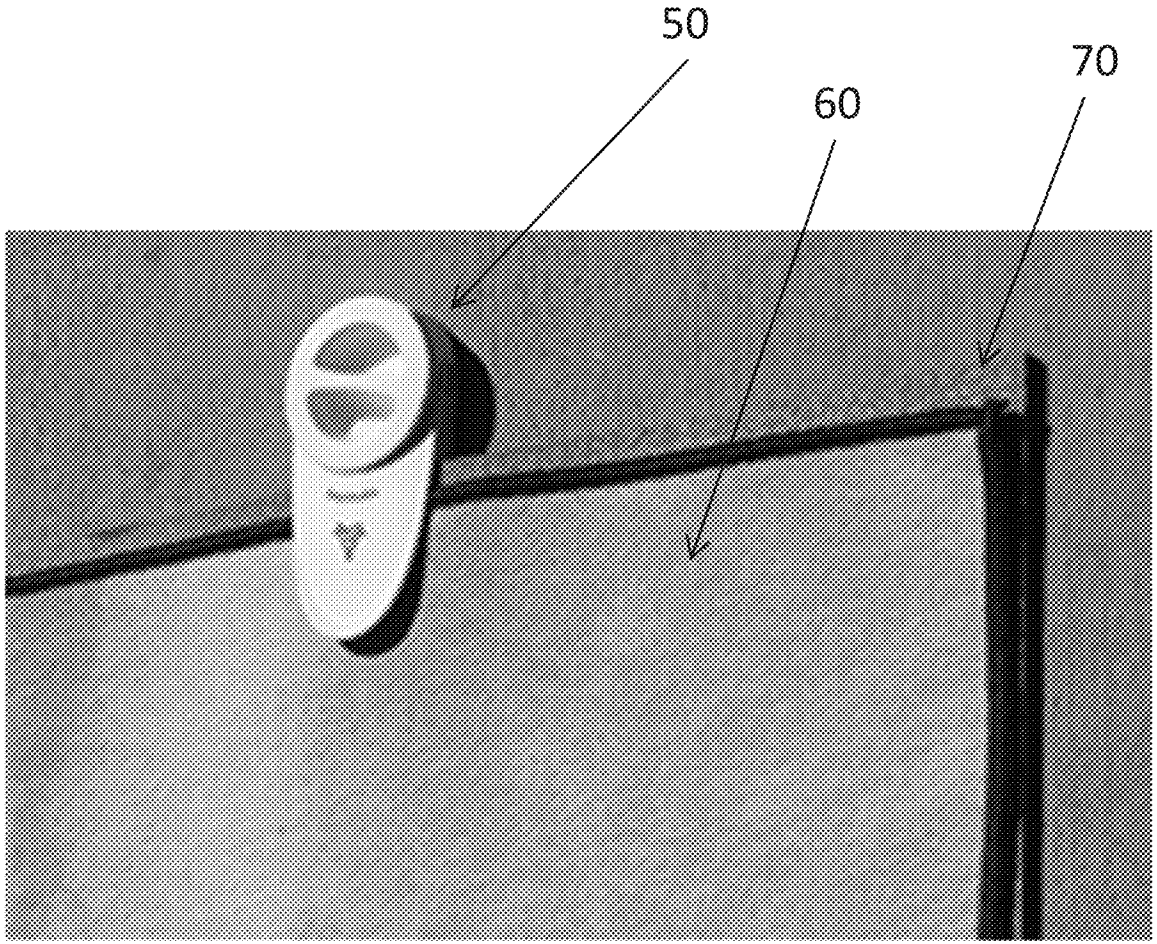
FIG. 10 is an photo of a yoga clip in use with a towel and mat.

The clip 50 is defined to include a first plate 100 and a second plate 200 that are configured to move in relation to each other to a closed configuration 400 (FIG. 3) and an open configuration 500 (FIG. 5).

The first plate 100 includes a first base section 110 and a first jaw section 120 adjacent to the first base section 110. The first base section includes an annular extending wall 130 with an inwardly facing threaded section 140 to define a well 145 therebetween. Positioned in the center of the well 145 is an upwardly extending shaft member 150. In addition, a pair of locking members 160 extend from external portions of the annular extending wall 130. The pair of locking members 160 are distal to each other at about 180° from each other, but this could easily be changed without deviating from the scope of the invention.

The second plate 200 includes a second base section 210 and a second jaw section 220 distal to the second base section. The second base section 210 includes a circular opening 221 with an inwardly extending annular rim 225 and further includes a downwardly extending shoulder section 230 extending around a portion of the circular opening. The shoulder section 230 is defined as being U-shaped and is configured to fit around the annular extending wall 130 when the two plates are assembled. The shoulder section 230 further includes a pair of slots 235 distal to each other and positioned to separately receive the pair of locking members 160.

The clip 100 further includes a threaded knob 300, which includes a top section 310 with an outwardly extending rim section 320. The threaded knob 300 includes an externally threaded member 330 extending from the underside of the top section 310 and which screws with the inwardly facing threaded section 140 on the first plate 100. When assembled the threaded member 330 from the threaded knob 300 fits through the circular opening 221 on the second plate 200 and tightens into the inwardly facing threaded section 140. The extending rim section 320 will rest against the inwardly extending annular rim 225. The threaded knob 300 further includes a centered bore 340 sized to receive the upwardly extending shaft member 150.

The shaft member 150 includes wings 152 on its upper end 154 that squeeze through the centered bore 340 and then expand to capture the threaded knob 300 to the first plate 100. The threaded knob 300 is configured to rotate along the corresponding threads to move the plates into the closed and open configurations.

The threaded knob includes finger indentations 350 to allow the user to easily grip the threaded knob 300 and twist to close or open. By closing the plates, the jaw sections are brought closure together to grip and capture a yoga mat to a towel.

In addition, each jaw section (120, 220) is defined to include a series of upwardly extending members 122, 222 spaced apart to provide for a gap 124, 224 between the upward extending members. The members can be triangular shaped as illustrated or shaped differently as needed. The two jaw sections may be aligned such that the extension align up with each other or can be aligned such that the extension of one member on one jaw section fits into the gap between two extension members on the other jaw section. Thus, when in the closed configuration the jaw sections are brought close together to grip and hold tightly the mat and towel together.

In another aspect of the invention, the first plate 100 may further include an arcuate ridge 180 along an underside portion 185 of the second base section 110. The arcuate ridge 180 is defined to help allow the clip 50 to grip into the floor when in use.

Figure 1:
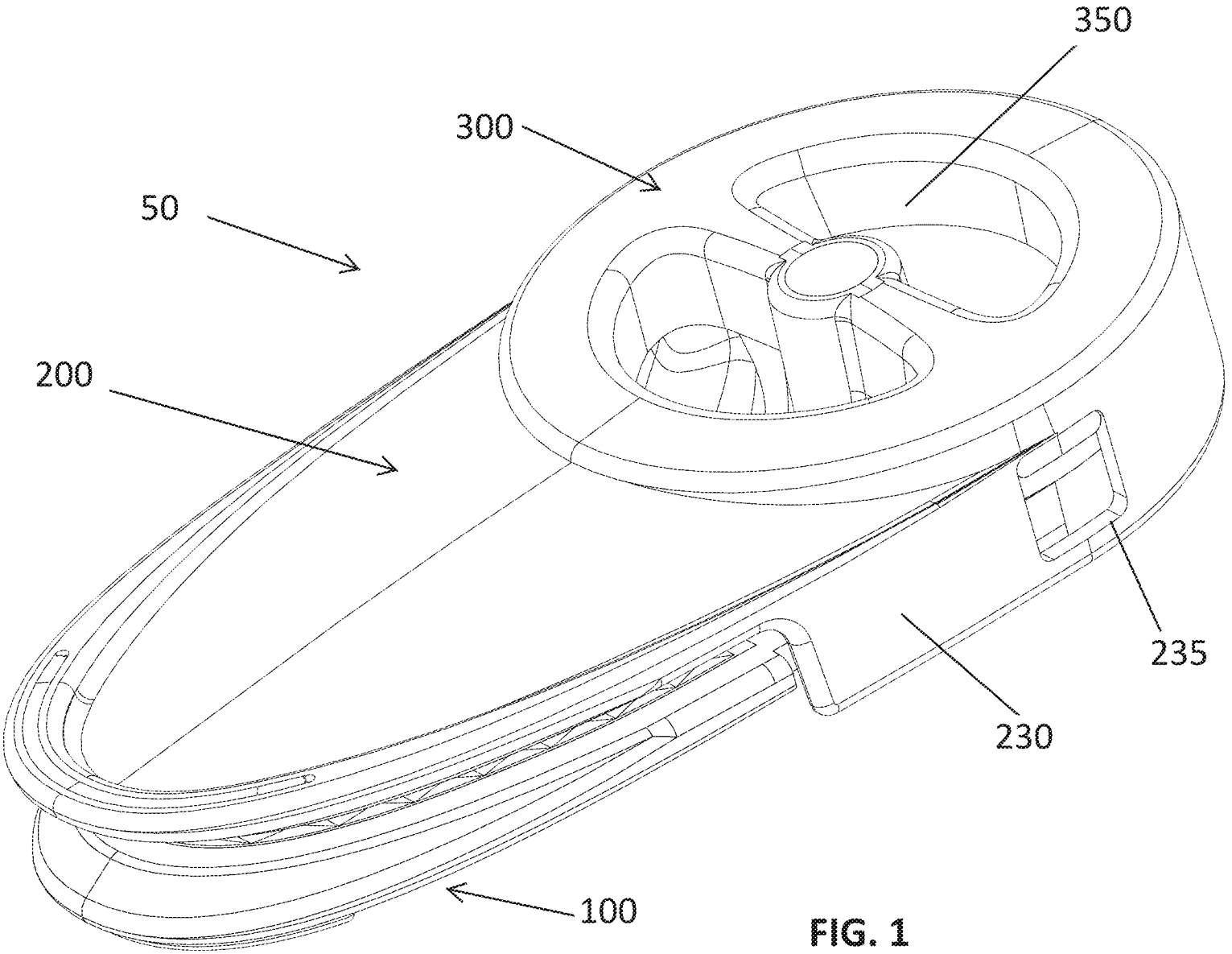
FIG. 1 is a top perspective view of a yoga clip in the closed configuration in accordance with one embodiment of the present invention.
Figure 2:
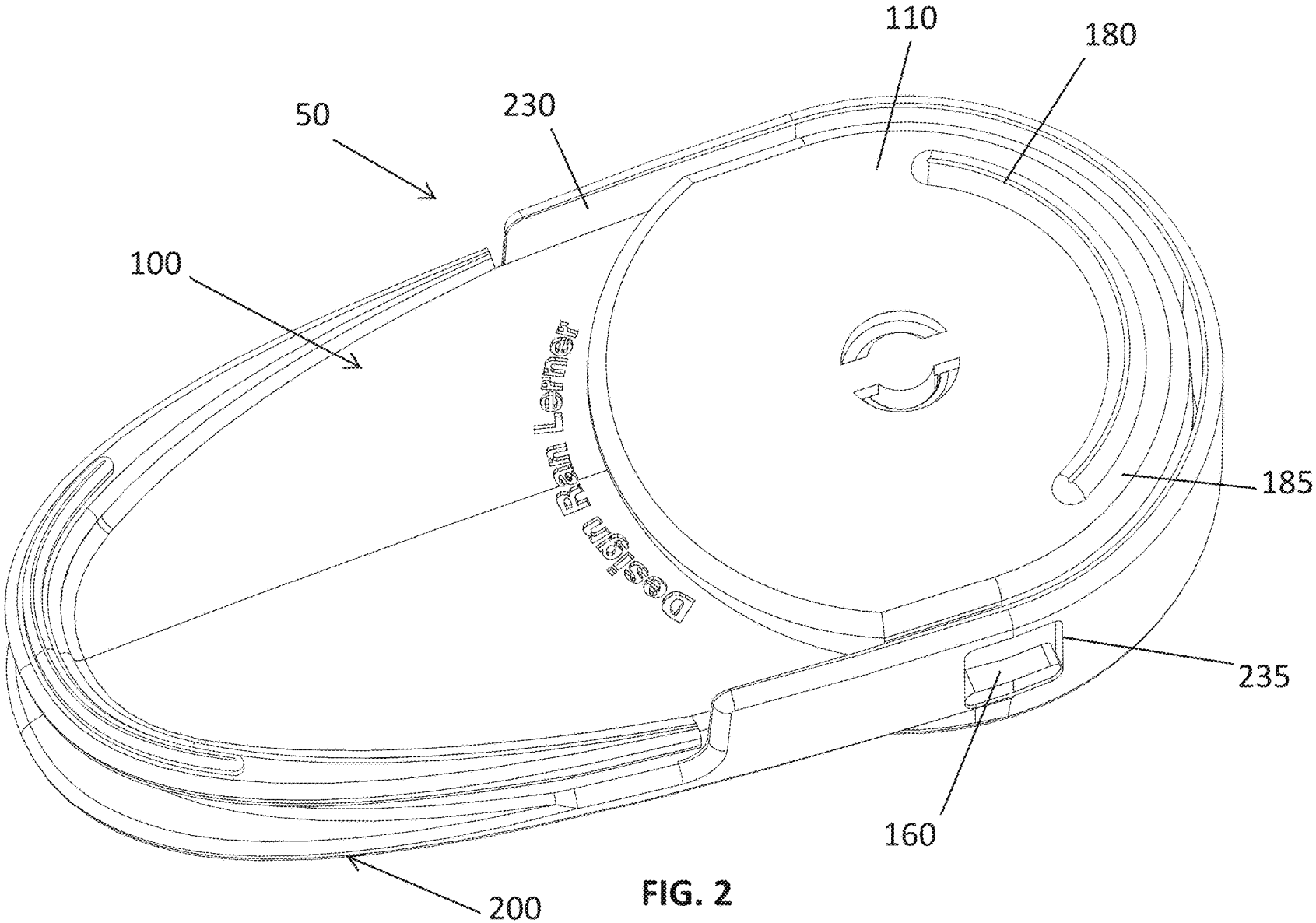
FIG. 2 is a bottom perspective view of a yoga clip in the closed configuration.
Figure 3:
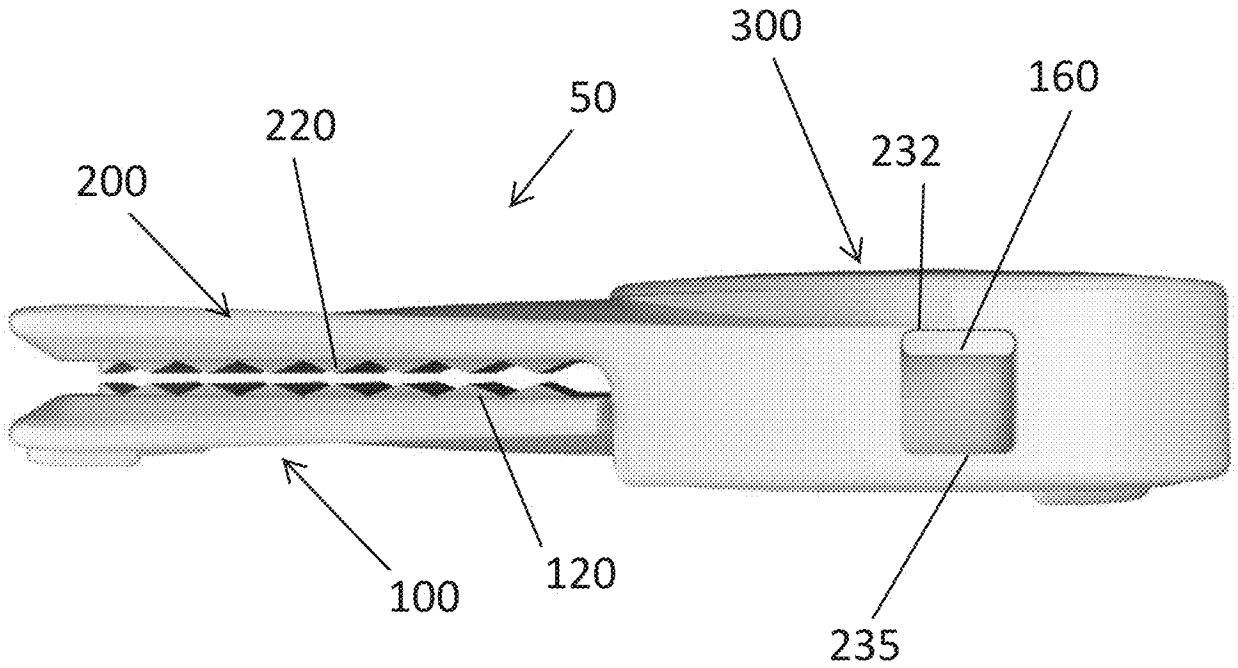
FIG. 3 is a side view of a yoga clip in the closed configuration.
Figure 4:
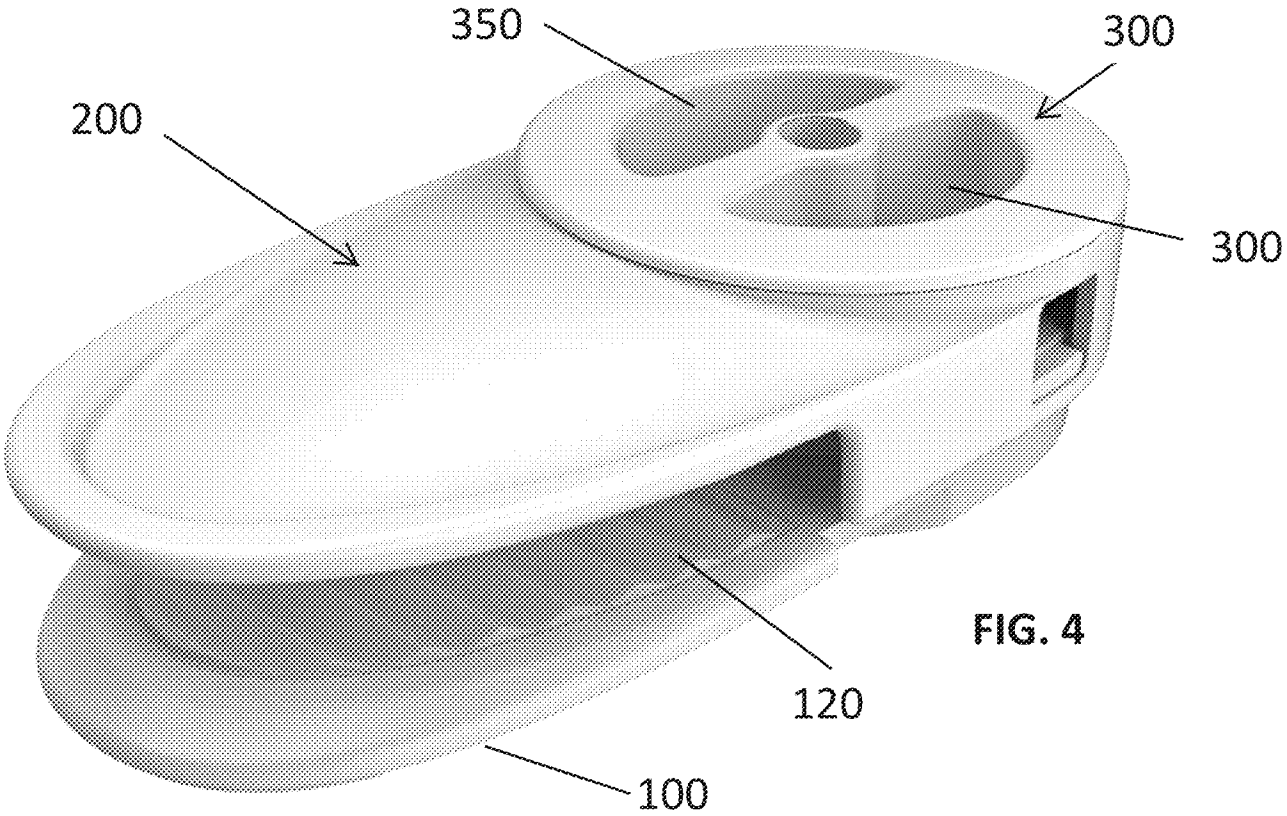
FIG. 4 is a top perspective view of a yoga clip in the open configuration in accordance with one embodiment of the present invention.

When assembled the pair of locking members 160 fit into the pair of slots 235 and act as stops for the rotation of the threaded knob 300. FIG. 3 shows the plates in a closed configuration with the locking members 160 positioned against the top 232 of the slots 235; while FIG. 5 shows the plates in an open configuration with the locking members 160 positioned against the bottom 234 of the slots 235.

In another aspect, the threaded know 300 may include a center cap 370 that fits over the centered bore 340.

In additional, the clip 50 has an extremely low profile. With a height between 18-20 centimeters, a length between 80-120 centimeters, and a width between 45-55 centimeters, the clip 50 is small and powerful. The low profile is important to allow the yogi participant to practice poses without stepping on or tripping over the clip. Having a low profile is extremely important in the development of the present invention. This is accomplished by ensuring the threaded knob fits within the openings of the two plates and does not protruding out of the top of the clip 50.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

I claim:

1. A clip for use with a yoga mat and towel, the clip comprising:

a first plate having a first jaw section, a second plate having a second jaw section disposed to face the first jaw section, and a threaded knob configured to move the first and second plates such that the first jaw section and the second jaw section move into and out of open and closed configurations; and the threaded knob being configured to fit within a well that is defined on the first plate and an opening that is defined on the second plate, such that a height profile of the threaded knob is substantially the same as a height profile of the first and second plates when assembled, and wherein the first plate includes a first base section adjacent the first jaw section, the first base section including:

an annular extending wall to define the well therebetween, an inwardly facing threaded section on the annular extending wall, and an upwardly extending shaft member being positioned in the center of the well.

2. The clip of claim 1, wherein the second plate includes a second base section adjacent the second jaw section, the second base section including:

an inwardly extending annular rim surrounding the opening defined on the second plate; and a downwardly extending shoulder section extending from a terminal edge defined by the inwardly extending annular rim, the shoulder section extending around a portion of the opening configured to fit around the annular extending wall.

3. The clip of claim 2, wherein the first plate further includes a pair of locking members separately extending from external portions of the annular extending wall; and wherein the second plate further includes a pair of slots separately located along the shoulder section to receive the pair of locking members when the first plate and second plate are assembled, thereby when assembled the pair of locking members slide into the pair of slots, and the wherein the slots act as stops for the movement of the first and second plates.

4. The clip of claim 2, wherein the downwardly extending shoulder section defines a U-shaped profile.

5. The clip of claim 2, wherein the threaded knob includes:

a top section with an outwardly extending rim section;

an externally threaded member extending from an underside of the top section to cooperatively thread with the inwardly facing threaded section on the first plate; and a center bore sized to receive the upwardly extending shaft member, such that when assembled, the extending rim section rests against the inwardly extending annular rim, the threaded member fits through the opening on the second plate and tightens into the inwardly facing threaded section on the first plate, and the upwardly extending shaft member rests within the center bore.

6. The clip of claim 5, wherein the shaft member includes wings on its upper end that squeeze through the centered bore and then expand to capture the threaded knob to the first plate.

7. The clip of claim 5, wherein threaded knob includes finger indentations to allow twisting of the threaded knob to move the first and second plates into and out of the open and closed configurations.

8. A clip for use with a yoga mat and towel, the clip comprising:

a first plate having a first jaw section, a second plate having a second jaw section disposed to face the first jaw section, and a threaded knob configured to move the first and second plates such that the first jaw section and the second jaw section move into and out of open and closed configurations; and the threaded knob being configured to fit within a well that is defined on the first plate and an opening that is defined on the second plate, such that a height profile of the threaded knob is substantially the same as a height profile of the first and second plates when assembled, wherein the first and second jaw sections each include a series of extending members spaced apart to provide for a gap therebetween.

9. The claim of claim 8, wherein the first plate includes a first base section adjacent the first jaw section, the first base section including an annular extending wall to define the well therebetween, an inwardly facing threaded section on the annular extending wall, and an upwardly extending shaft member being positioned in the center of the well.

10. The clip of claim 9, wherein the second plate includes a second base section adjacent the second jaw section, the second base section including an inwardly extending annular rim surrounding the opening, and a downwardly extending shoulder section extending from a terminal edge defined by the inwardly extending annular rim, the shoulder section extending around a portion of the opening configured to fit around the annular extending wall.

11. The clip of claim 10, wherein the first plate further includes a pair of locking members separately extending from external portions of the annular extending wall; and wherein the second plate further includes a pair of slots separately located along the shoulder section to receive the pair of locking members when the first plate and second plate are assembled, thereby when assembled the pair of locking members slide into the pair of slots, and the wherein the slots act as stops for the movement of the first and second plates.

12. The clip of claim 11, wherein the threaded knob includes:

a top section with an outwardly extending rim section;

an externally threaded member extending from an underside of the top section to cooperatively thread with the inwardly facing threaded section on the first plate; and a center bore sized to receive the upwardly extending shaft member, such that when assembled, the extending rim section rests against the inwardly extending annular rim, the threaded member fits through the opening on the second plate and tightens into the inwardly facing threaded section on the first plate, and the upwardly extending shaft member rests within the center bore.

13. A clip for use with a yoga mat and towel, the clip comprising:

a first plate having a first base section adjacent to a first jaw section, and wherein the first base section includes an annular extending wall to define a well therebetween, an inwardly facing threaded section on the annular extending wall;

a second plate having a second base section adjacent to a second jaw section, and wherein the second jaw section disposed to face the first jaw section, and wherein the second base section includes an inwardly extending annular rim surrounding an opening; and a downwardly extending shoulder section extending from a terminal edge defined by the inwardly extending annular rim, the shoulder section extending around a portion of the opening configured to fit around the annular extending wall; and a threaded knob being configured to fit within the well defined on the first plate and the opening defined on the second plate, the threaded knob further including finger indentations about a top section of the threaded knob to allow a user to twisting the threaded knob and to maintain a height profile of the threaded knob at substantially the same height of the first and second plates when assembled, and wherein the threaded knob being further configured to move the first and second plates such that the first jaw section and the second jaw section move into and out of open and closed configurations.

14. The clip of claim 13, wherein the threaded knob further comprising:

a top section with an outwardly extending rim section;

an externally threaded member extending from an underside of the top section to cooperatively thread with the inwardly facing threaded section on the first plate; and such that when assembled, the extending rim section rests against the inwardly extending annular rim, the threaded member fits through the opening on the second plate and tightens into the inwardly facing threaded section on the first plate.

15. The clip of claim 14, wherein the first plate further includes a pair of locking members separately extending from external portions of the annular extending wall; and wherein the second plate further includes a pair of slots separately located along the shoulder section to receive the pair of locking members when the first plate and second plate are assembled, thereby when assembled the pair of locking members slide into the pair of slots, and the wherein the slots act as stops for the movement of the first and second plates.

16. The clip of claim 15, wherein the downwardly extending shoulder section defines a U-shaped profile.

17. The clip of claim 14, wherein the first plate includes an upwardly extending shaft member positioned in the center of the well and the threaded knob includes a center bore sized to receive the upwardly extending shaft member.

18. The clip of claim 17, wherein the shaft member includes wings on its upper end that squeeze through the centered bore and then expand to capture the threaded knob to the first plate.

19. The claim of claim 13, wherein the first and second jaw sections each include a series of extending members spaced apart to provide for a gap therebetween.

* * * * *